US005826148A

United States Patent [19]

Iino et al.

[11] Patent Number: 5,826,148

[45] Date of Patent: Oct. 20, 1998

[54] LIQUID DEVELOPER TRANSPORTING DEVICE AND LIQUID DEVELOPING DEVICE

[75] Inventors: Shuji Iino, Mùko; Toshimitsu Fujiwara, Kobe; Hidetoshi Miyamoto, Takatsuki; Takaji Kurita, Osakasayama, all of Japan

[73] Assignee: Minolta Co., Ltd., Osaka, Japan

[21] Appl. No.: 758,762

[22] Filed: Dec. 19, 1996

Related U.S. Application Data

[63] Continuation of Ser. No. 638,041, Apr. 26, 1996, abandoned.

[30] Foreign Application Priority Data

Apr. 27, 1995 [JP] Japan ..... 7-104081

[51] Int. Cl.[6] ..... G03G 15/10

[52] U.S. Cl. ..... 399/240; 39/239

[58] Field of Search ..... 399/237, 239, 399/240

[56] References Cited

U.S. PATENT DOCUMENTS

| | | | |
|---|---|---|---|
| 3,667,428 | 6/1972 | Smith | 118/661 X |
| 4,021,586 | 5/1977 | Matkan | 118/661 D X |
| 4,050,804 | 9/1977 | Silverberg | 355/256 |
| 4,056,314 | 11/1977 | Silverberg | 355/256 |
| 4,068,938 | 1/1978 | Robertson | 355/326 R |
| 4,076,405 | 2/1978 | Silverberg | 355/256 |
| 4,083,326 | 4/1978 | Kroll et al. | 118/661 |
| 4,202,620 | 5/1980 | Klavan et al. | 355/256 |
| 4,245,023 | 1/1981 | Cassiers et al. | 118/661 X |
| 4,373,469 | 2/1983 | Kuge et al. | 118/661 X |
| 4,686,936 | 8/1987 | Chow | 118/661 |
| 5,561,264 | 10/1996 | Iino et al. | 399/240 |
| 5,574,548 | 11/1996 | Iino et al. | 399/240 |

FOREIGN PATENT DOCUMENTS

| | | | |
|---|---|---|---|
| 45-35759 | 11/1970 | Japan . | |
| 2-302765 | 12/1990 | Japan | 355/256 |
| 6-222677 | 8/1994 | Japan | 355/256 |
| 1 250 214 | 10/1971 | United Kingdom . | |

*Primary Examiner*—Matthews Smith
*Attorney, Agent, or Firm*—McDermott, Will & Emery

[57] ABSTRACT

A liquid developer transfer device disposed between a reservoir accommodating a liquid developer having a fluid medium and electrically charged toner particles dispersed therein and an electrostatic latent image carrying member, which performs toner transfer by repeating electrodeposition.

21 Claims, 5 Drawing Sheets

LIQUID DEVELOPER TRANSPORTING DEVICE AND LIQUID DEVELOPING DEVICE

This is a continuation application of application Ser. No. 08/638,041, filed Apr. 26, 1996, now abandoned.

BACKGROUND OF THE INVENTION

1. Field of the Invention

The present invention relates to a liquid developer transporting device and a liquid developing device for use in image forming apparatuses which form images by developing an electrostatic latent image using liquid developer comprising electrically charged toner particles dispersed in a fluid medium.

The liquid developer transporting device described in the specifications includes devices which are disposed between an electrostatic latent image carrying member and a reservoir accommodating liquid developer and transport said liquid developer from the reservoir to the electrostatic latent image carrying member, devices built into the liquid developing device installed in an image forming apparatus, and devices which themselves are provided with a developing means.

2. Description of the Related Art

Electrophotographic methods for image formation, wherein an electrostatic latent image formed on a latent image carrying member such as a photosensitive member is developed by electrically charged toner particles, can be broadly divided into dry developing methods which directly employ a toner powder, and liquid developing methods which employ a liquid developer having a toner dispersed in a carrier liquid.

In conventional liquid developing methods, an electrostatic latent image formed on the surface of a photosensitive member is developed by immersing the photosensitive surface in a liquid developer.

Typically, in liquid developing methods, images are obtainable which have high resolution and excellent halftones because a toner having a small particle diameter is used.

To obtain images having high resolution and excellent halftones, ideally, all of toner particles show uniform chargeability in liquid developer. However, existence of irregularly charged toner is inevitable due to deviation of particles size and composition between each of particles or the like. Therefore, fog on the background image is tend to appear which affect to obtaining images having high resolution and excellent halftones.

SUMMARY OF THE INVENTION

An object of the present invention is to provide a liquid developer transporting device and a liquid developing device which are novel and useful and eliminate the previously described disadvantages.

Another object of the present invention is to provide a liquid developer transporting device and a liquid developing device capable of selectively supplying for development toners having excellent chargeability.

Another object of the present invention is to provide a liquid developer transporting device and a liquid developing device capable of producing high quality images without background fog.

Yet another object of the present invention is to provide a liquid developer transporting device and a liquid developing device capable of producing high resolution images.

Another object of the present invention is to provide a liquid developer transporting device and a liquid developing device capable of producing images having sufficiently high image density.

A further object of the present invention is to provide a liquid developer transporting device and a liquid developing device of simple construction.

A still further object of the present invention is to provide a liquid developer transporting device and a liquid developing device which can be disposed at various position relative to the electrostatic latent image carrying member.

The present inventors conducted various investigations to achieve the above-mentioned objects and discovered that these objects could be achieved by repeating electrodeposition of toner. Toner electrodeposition pertains to the adhesion of toner on a developer carrying member by providing an electrode in opposition to a toner carrying member, and applying a electric voltage between the electrode and the toner carrying member.

The present invention is based on the above-mentioned knowledge and provides a liquid developer transporting device disposed between an electrostatic latent image carrying member and a reservoir accommodating a liquid developer comprising charged toner particles dispersed in a fluid medium, said liquid developer transporting device performing toner transportation by repeating electrodeposition.

BRIEF DESCRIPTION OF THE DRAWINGS

In the following description, like parts are designated by like reference numbers throughout the several drawings.

DESCRIPTION OF THE PREFERRED EMBODIMENTS

The present invention is described in detail hereinafter by way of the preferred embodiments.

<Construction of the Device>

Figure 1:
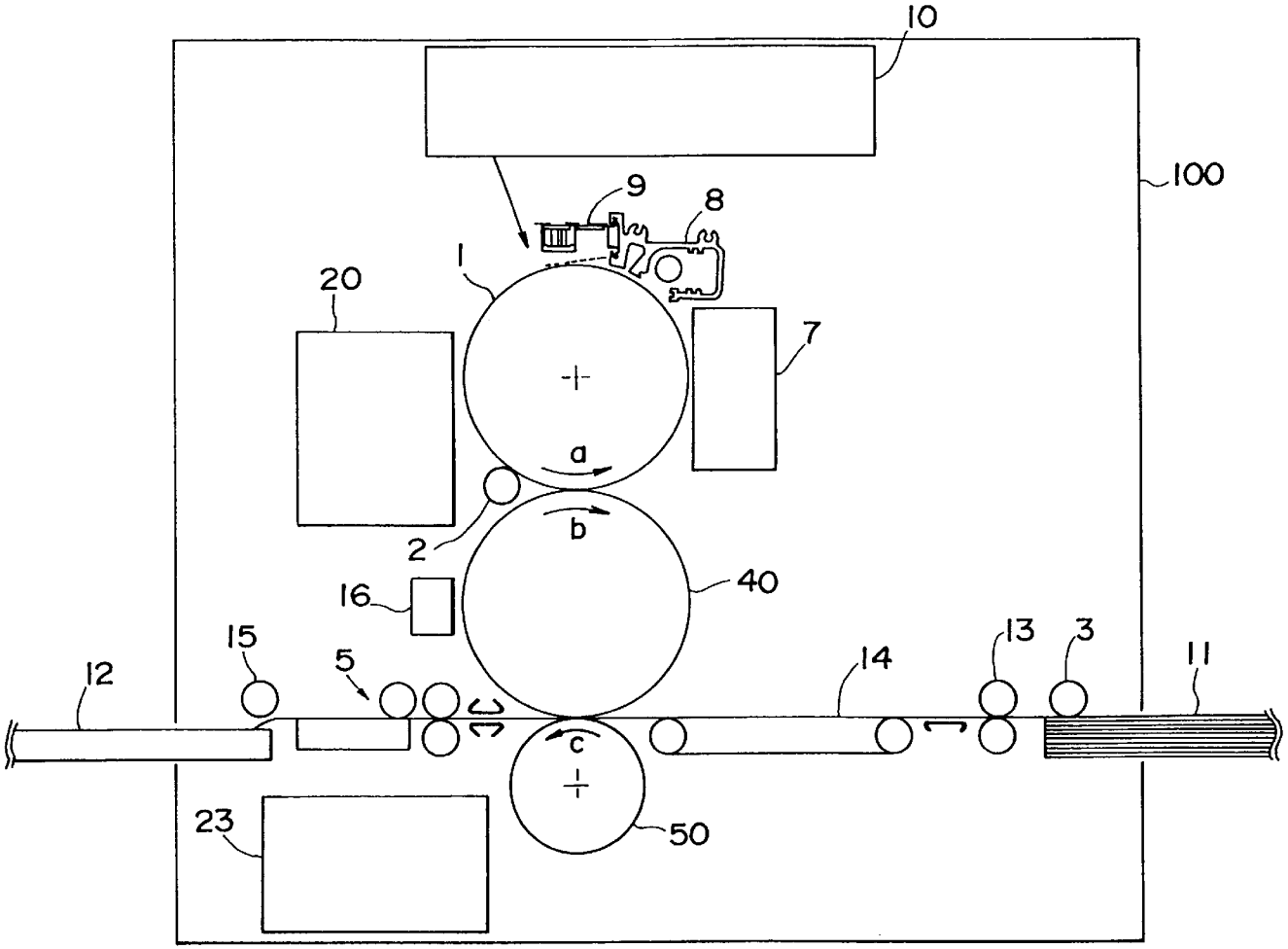
FIG. 1 is a section view of an electrophotographic printer using liquid developer.

FIG. 1 is a section view of electrophotographic printer 100 provided with an image forming apparatus incorporating the liquid developer transporting device which is a preferred embodiment of the present invention. As shown in FIG. 1, the top portion of printer 100 is provided with a laser generator 10 for generating a laser beam to irradiate photosensitive drum 1 based on image data transmitted from a host computer or the like (not illustrated).

Near the center of printer 100 is arranged a photosensitive drum 1 on the surface of which is formed an electrostatic latent image and which is rotatable in the arrow a direction in the drawing. Photosensitive drum 1 comprises a photosensitive layer formed on a cylindrical electrically conductive substrate.

Liquid developing device 20 is provided at the side of photosensitive drum 1. Below photosensitive drum 1 is provided an intermediate transfer member 40 for transferring a toner image from the surface of photosensitive drum 1. Intermediate transfer member 40 is a drum-shaped member having the same external diameter as photosensitive drum 1, and is supported so as to be rotatable in the arrow b direction in the drawing, i.e., rotatable in the same direction as photosensitive drum 1 in the area opposite photosensitive drum 1. Intermediate transfer member 40 comprises a resin layer provided on the surface of a drum-like electrically conductive support member. The volume resistivity of the resin layer is desirably $10^4$ to $10^{10}$ Ω/cm, and preferably $10^5$ to $10^9$ Ω/cm. Alternatively, a rubber layer may be substituted for the resin layer. A predetermined transfer bias voltage is applied between intermediate transfer member 40 and photosensitive drum 1.

Arranged sequentially around the periphery of photosensitive drum 1 are charger 9 for uniformly charging the surface of photosensitive drum 1, squeeze roller 2 for reducing the carrier liquid from the image formed on the surface of photosensitive drum 1, cleaner 7 for cleaning the surface of photosensitive drum 1, and eraser lamp 8 for eliminating the residual charge remaining on the surface of photosensitive drum 1. A cleaner 16 is provided near intermediate transfer member 40 to clean the surface of intermediate transfer member 40.

At the bottom of printer 100 are provided a paper cassette 11 accommodating paper sheets therein, sheet transport belt 14 for transporting sheets via air suction, secondary transfer roller 50 for transferring a toner image formed on intermediate transfer member 40 onto a paper sheet, fixing device 5 for fixing the transferred toner image on the paper sheet, discharge tray 12 for receiving sheets ejected from the printer interior, and liquid developer storage tank 23 for storing liquid developer. Secondary transfer roller 50 is provided below intermediate transfer member 40 and in opposition therewith, and is supported so as to be rotatable in the arrow c direction in the drawing, i.e., in the same direction as intermediate transfer member 40 in the area opposite transfer member 40. Secondary transfer roller 50 is provided with a built-in heater.

Provided in the vicinity of paper cassette 11 are feed roller 3 for feeding sheet from cassette 11 to the interior of the printer, and timing roller 13 for adjusting the timing for feeding the sheet to the interior of the printer. Provided in the vicinity of discharge tray 12 is a discharge roller 15 for ejecting sheets from the interior of the printer to discharge tray 12.

The printing operation of printer 100 is described below.

After photosensitive drum 1 starts rotation at constant speed and is uniformly charged by charger 9, and an electrostatic latent image is formed on the charged surface by irradiation of a laser beam emitted from laser generator 10. Thus-obtained electrostatic latent image is developed by liquid developing device 20 using a liquid developer so as to be rendered visible, and excess carrier liquid is subsequently removed by squeeze roller 2.

On the other hand, intermediate transfer member 40 also begins rotation. An electric voltage is applied to intermediate transfer member 40 and the polarity of the applied voltage is opposite the charge polarity of the toner. Thus, the toner image formed on the surface of photosensitive drum 1 is transferred (primary transfer) to intermediate transfer member 40 from photosensitive drum 1.

Feed roller 3 provided adjacent to paper cassette 11 also begins rotation, and a paper sheet is fed from cassette 11 to the interior of the printer. The feeding of the sheet is started synchronously with the toner image formed on intermediate transfer member 40, such that the sheet is transported by sheet transport belt 14 to the area of confrontation between intermediate transfer member 40 and secondary transfer roller 50 (secondary transfer region). At the secondary transfer region, the toner image formed on the intermediate transfer member 40 is subjected to heat and pressure provided by secondary transfer roller 50 and transferred to the sheet. The toner image is permanently fixed to the sheet by fixing device 5, whereupon the sheet is ejected to discharge tray 12 by discharge roller 6.

After the toner image transfer ends, residual developer remaining on the surface of photosensitive drum 1 is removed therefrom by cleaner 7 and the residual charge remaining on the photosensitive surface is eliminated by eraser lamp 8 in preparation for a subsequent printing. Similarly, after the toner image transfer ends, residual developer remaining on the surface of intermediate transfer member 40 is removed therefrom by cleaner 16 in preparation for a subsequent printing. Thus, a series of printing operation is completed.

Figure 2:
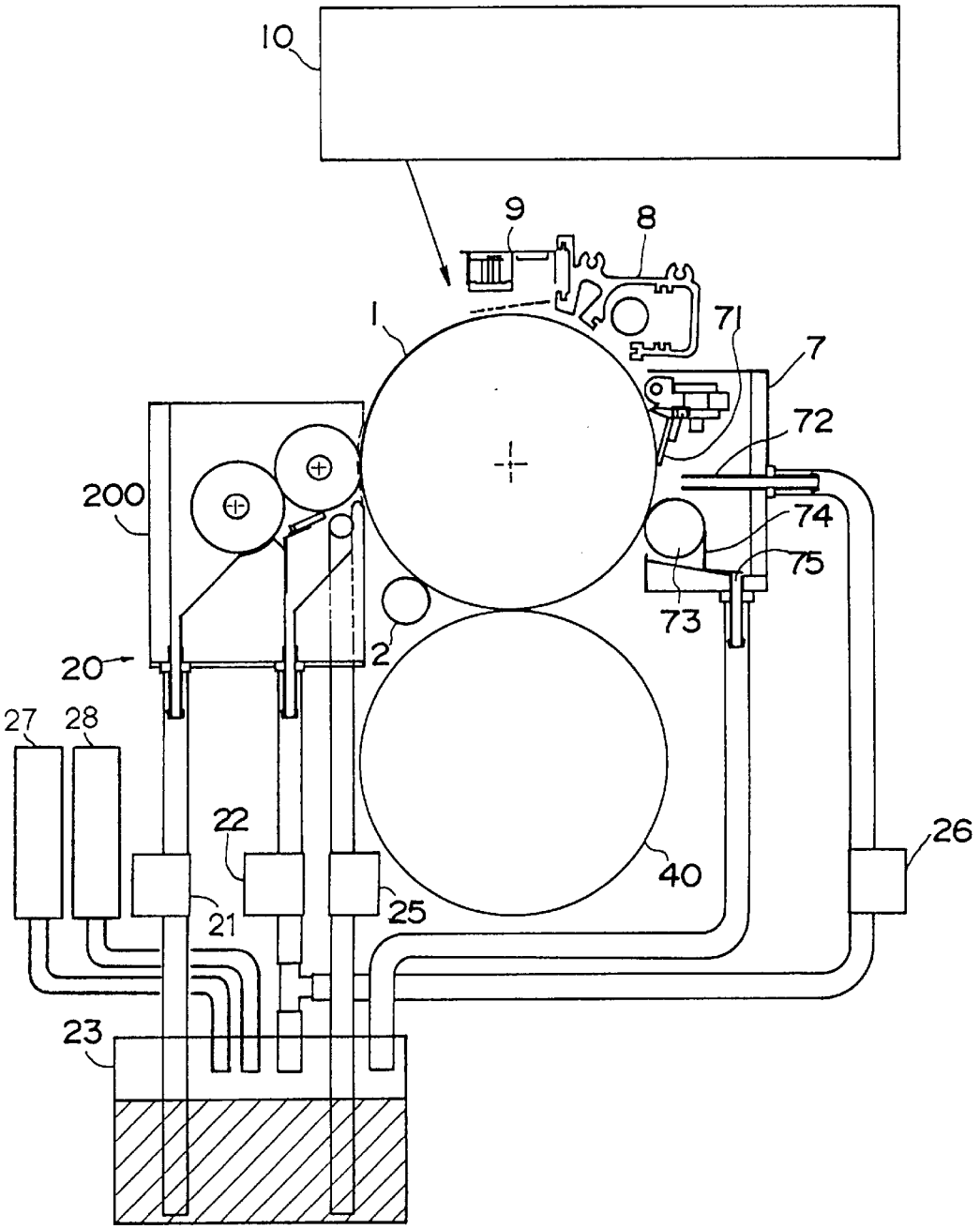
FIG. 2 illustrates the relationships among the liquid developing device, cleaning device, and liquid developer tank.

FIG. 2 illustrates the relationships among liquid developing device 20, cleaning device 7, and developer storage tank 23. As shown in FIG. 2, liquid developing device 20 is provided with a liquid supply device 21 for supplying liquid developer accommodated in developer storage tank 23, developing head 200 confronting photosensitive drum 1 for developing an electrostatic latent image on photosensitive drum 1 with liquid developer supplied via liquid supply device 21, liquid collecting device 22 for returning the liquid developer in developing head 200 to developer storage tank 23, and cleaning liquid supply device 26 for supplying liquid developer in developer storage tank 23 as a cleaning liquid to developing head 200. The liquid developer in developer storage tank 23 is supplied at suitable timing with carrier liquid and toner via carrier liquid replenishment device 27 and toner replenishment device 28 so as to maintain a constant toner concentration and liquid quantity.

Part of the liquid developer returned to developer storage tank 23 via liquid collecting device 22 is supplied to cleaner 7 as cleaning liquid via cleaning liquid supply device 26.

Cleaner 7 is provided at the side of photosensitive drum 1 which is opposite the side of liquid developing device 20, and comprises a blade 71 for removing residual liquid developer from photosensitive drum 1, nozzle 72 connected to cleaning liquid supply device 26, and liquid collection aperture 75 for collecting liquid developer removed by blade 71.

Nozzle 72 is provided with a plurality of discharge apertures along the lengthwidth direction of photosensitive drum 1, and sprays cleaning liquid supplied from cleaning liquid supply device 26 to a contact region between blade 71 and photosensitive drum 1. Thus, residual toner is readily removed by blade 71.

Liquid collection aperture 75 is disposed at the lowest point of cleaner 7, and adjacent thereto are provided a liquid collection blade 74 and liquid collection roller 73 for directing the liquid in cleaner 7 to liquid collection aperture 75. Liquid collection roller 73 confronts photosensitive drum 1 below blade 71, and is rotated in the same direction as photosensitive drum 1 at the area opposite photosensitive drum 1. Furthermore, liquid collection blade 74 is provided adjacent to liquid collection roller 73, so as to remove liquid developer on the surface of liquid collection roller 73 and direct said developer to liquid collection aperture 75.

After the liquid developer removed by blade 71 and the cleaning liquid sprayed on photosensitive drum 1 from nozzle 72 fall downward, they are transported to liquid collection aperture 75 via the rotation of liquid collection roller 73, and are directed by liquid collection blade 74 so as to be recovered in liquid collection aperture 75. The recovered liquid developer is then transported to developer storage tank 23.

Figure 3:
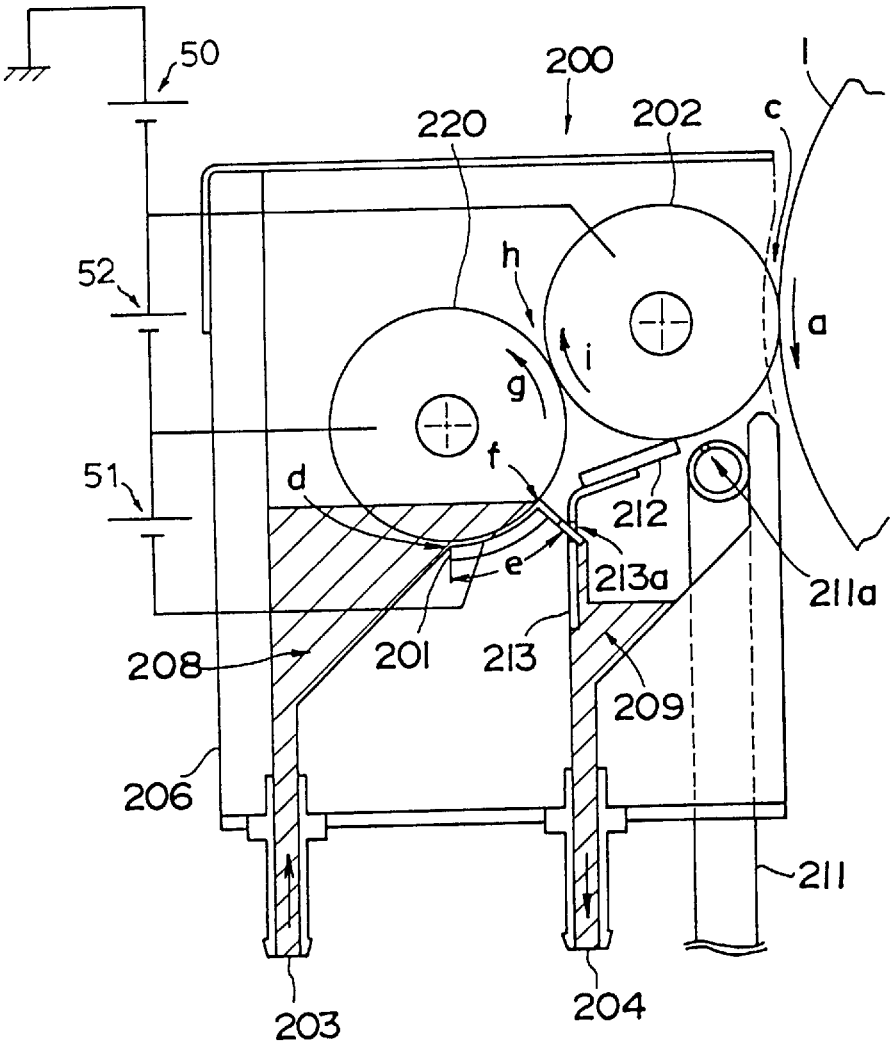
FIG. 3 is an enlarged section view of the developing head.

FIG. 3 is an enlargement of the vicinity of developing head 200. As described below, developing head 200 shown in FIG. 3 is provided with a mechanism for transporting liquid developer from a developer tank to an electrostatic latent image carrying member via a total of two electrodepositions. Furthermore, a developing means is also provided with a second developer carrying member for accomplishing said second electrodeposition.

As shown in FIG. 3, developing head 200 comprises a developer tank 208 for temporarily storing liquid developer, electrodeposition roller 220 for maintaining liquid developer in developing tank 208, developing roller 202 for receiving and maintaining liquid developer on the surface thereof via electrodeposition roller 220, frame 206 for supporting electrodeposition roller 220 and developing roller 202, liquid collection tank 209 for collecting liquid developer from developer tank 208, cleaning blade 212 for removing residual liquid developer from the surface of developing roller 202, and tube 211 for spraying cleaning liquid on developing roller 202. The shaded portion in the drawing indicates liquid developer.

Developing roller 202 and electrodeposition roller 220 are cylindrical rollers formed of electrically conductive material, and are arranged parallel to the lengthwidth direction of photosensitive drum 1. Developing roller 202 is provided at the side of photosensitive drum 1, and is supported so as to be rotatable in the arrow i direction in the drawing, i.e., in the same direction as the direction of rotation of photosensitive drum 1 at a position confronting photosensitive drum 1. Electrodeposition roller 220 is provided at the side of developing roller 202 on the opposite side relative to photosensitive drum 1, and is supported so as to be rotatable in the arrow g direction (i.e., in the same direction as the direction of rotation of developing roller 202 at a position confronting developing roller 202.

Developer tank 208 is provided below electrodeposition roller 220. At the bottom of developer tank 208 is formed a liquid supply aperture 203 connected to liquid supply device 21, as shown in FIG. 2, which supplies liquid developer from liquid supply aperture 203 to developer tank 208 during development, so as to saturate the bottom portion of electrodeposition roller 220 with liquid developer within developing tank 208.

Part of the top edge of the wall forming developer tank 208 is adjacent to the bottom of electrodeposition roller 220, and forms an edge portion f extending parallel to the lengthwidth direction of electrodeposition roller 220. After developer tank 208 is filled with liquid developer, excess liquid developer flows over edge portion f.

The interior wall surface of developer tank 208 opposite the lowest point of electrodeposition roller 220 from edge portion f comprises a curved electrode 201 conforming to the surface of electrodeposition roller 220 with a predetermined spacing maintained therebetween.

The first electrodeposition is accomplished at opposition region d between electrode 201 and electrodeposition roller 220. That is, charged toner particles in the liquid developer are acted upon by an electrostatic force and migrate to electrodeposition roller 220 via a voltage applied by power supply 51 connected with electrodeposition roller 220 and electrode 201 when liquid developer is filled to region d, so as to form a thin toner layer (a thin layer having an extremely high toner concentration of liquid developer) of uniform thickness on the surface of electrodeposition roller 220, and form a layer of carrier liquid of uniform thickness substantially without toner.

For the purpose of simplifying the following description, "the nth electrodeposition area" refers to the area of the nth occurrence of electrodeposition when n times electrodeposition are performed.

The voltage applied between electrode 201 and electrodeposition roller 220 may be a direct current voltage (DC), an alternative current voltage (AC) overlaid on a direct current voltage, or a pulse voltage overlaid on a direct current voltage. The DC component is desirably 100 to 2,000 V, and preferably 200 to 1,500 V. When an AC component overlay is overlaid, the peak voltage is desirably 200 to 4,000 V, and preferably 400 to 3,000 V, and the frequency is 10 to 10,000 Hz.

When the length of the area of confrontation between electrode 201 and electrodeposition roller 220 indicated by arrow e in FIG. 3 is set at 3 to 80 mm and preferably at 5 to 50 mm, there is adequate time for the required migration of toner to form a thin layer, such that a thin layer having a high concentration of liquid developer can be formed. When the gap between the electrode 201 and electrodeposition roller 220 is set at 0.1 to 10 mm, and preferably at 0.3 to 3 mm, there is excellent migration of the liquid developer to opposition region d, such that the aforementioned liquid developer layer is formed which comprises a thin toner layer and a carrier liquid layer.

On the other hand, a second electrodeposition is accomplished at confrontation area (second electrodeposition) h between electrodeposition roller 220 and developing roller 202. That is, toner contained in liquid developer maintained on electrodeposition roller 220 migrates to developing roller 202 due to an electrostatic force generated by a voltage applied by power supply 52 connected with electrodeposition roller 220 and developing roller 202, such that a toner layer of uniform thickness is formed on the surface of developing roller 202.

The voltage applied between electrodeposition roller 220 and developing roller 202 may be a direct current voltage (DC), an alternative current voltage (AC) overlaid on a direction current voltage, or a pulse voltage overlaid on a direct current voltage. The DC component is desirably 100 to 2,000 V, and preferably 200 to 1,500 V. When an AC component overlay is overlaid, the peak voltage is desirably 200 to 4,000 V, and preferably 400 to 3,000 V, and the frequency is 10 to 10,000 Hz.

For example, voltages of each of power supplies 51, 52 may be set at direct voltages of 1,000 V, 500 V respectively.

The gap between electrodeposition roller 220 and developing roller 202 at second electrodeposition area h may be optionally set within a range of 0 to 2 mm. That is, the liquid developer on the surface of electrodeposition roller 220, if within contact range of developing roller 202, may be in states of contact or non-contact with both said rollers.

Similarly, the gap between developing roller 202 and photosensitive drum 1 at opposition area c (hereinafter referred to as "developing region") may be optionally set within a range of 0 to 2 mm.

Liquid collection tank 209 is provided adjacent to edge portion f and below developing roller 202. On the wall surface of liquid collection tank 209 is provided a support panel 213 for supporting cleaning blade 212 so as to press against the bottom portion of developing roller 202 against the direction of rotation of developing roller 202. Support panel 213 is provided with a plurality of holes 213*a* in the lengthwidth direction, such that liquid developer which exceeds the edge portion f of developer tank 208 flows through holes 213*a* into liquid collection tank 209. On the bottom of liquid collection tank 209 is formed a liquid collection aperture 204 connected to liquid collection device 22, such that liquid developer flowing into liquid collection tank 209 is recovered from liquid collection aperture 204 and returned to developer tank 23, as shown in FIGS. 1 and 2.

Tube 211 is arranged between developing roller 202 and liquid collection tank 209, and is connected to cleaning liquid supply device 25, as shown in FIG. 2. Tube 211 is arranged parallel to the lengthwidth direction of developing roller 202, and is provided with a plurality of spray ports 211*a* in the lengthwidth direction of developing roller 202 at positions confronting developing roller 202, such that cleaning liquid is sprayed from spray ports 211*a* on developing roller 202.

The operation of liquid developing device 20 is described below.

First, liquid supply device 21 is operated to supply liquid developer from liquid supply aperture 203 to developer tank 208. After liquid developer passes through first electrodeposition area d and liquid collection tank 209, aforementioned developer passes through liquid collection aperture 204 and is recovered in developer storage tank 23 via liquid collection device 22, and subsequently again supplied to developing head 200 by liquid supply device 21. Thus, liquid developer circulates within developing device 20 during development.

In developing device 20, the liquid collection efficiency of liquid collection device 22 is greater than the liquid supplying efficiency of liquid supply device 21. Accordingly, the level of liquid developer within developing head 200 is constant at the highest position sightly above edge portion f (i.e., top edge of electrode 201) of developer tank 208 as shown in FIG. 3.

On the other hand, developing roller 202 and electrodeposition roller 220 begin rotation. A voltage is applied between electrode 201 and electrodeposition roller 220, and while liquid developer passes through first electrodeposition region d, charged toner particles in the liquid developer are acted upon by an electrostatic force and caused to migrate to electrodeposition roller 220 side, such that a uniform thin toner layer is formed on the surface of electrodeposition roller 220, and a uniform thin carrier liquid layer is formed substantially without toner particles on the top side of said roller. Thus, the first electrodeposition is accomplished.

In the present embodiment, liquid developer circulates to first electrodeposition area d and fresh liquid developer is continuously supplied, such that a suitable amount of toner can be maintained on electrodeposition roller 220 even when electrodeposition roller 220 is rotated at high speed in conjunction with the drawing of liquid developer from the developer tank 208. Thus, in the present embodiment, an adequate amount of toner can be drawn from the developer tank to accomplish high-speed developing.

Liquid developer maintained on electrodeposition roller 220 is transported to second electrodeposition region h via the rotation of electrodeposition roller 220. Toner particles contained in the liquid developer transported to second electrodeposition region h are acted upon by an electrostatic force generated by a voltage applied to said second electrodeposition region h, so as to adhere to the surface of developing roller 202 and form a uniform toner layer thereon. At this time, the toner originally having lower charge or the toner losing charge on the electrodeposition roller 220 remains on roller 220 due to dull reactiveness to the electric field, whereas the toner having excellent chargeability remaining on the electrodeposition roller 220 selectively migrates to developing roller 202.

The art of the single toner electrodeposition is disclosed in, for example, GB1250214.

The above-mentioned disclosures pertain only to a simple single electrodeposition, wherein both toner expressing excellent chargeability and inadequately charged toner adhere to the developer carrying member either because inadequately charged toner present in the liquid developer is mechanically adhered, and the charged toner enfolds the inadequately charged toner when the charged toner migrates within the electric field, or the charge is rapidly lost from low resistance toner in the electrodeposited toner, and such toner is transported to the developing region, and reduces image quality by producing background fog and the like.

In contrast, it was discovered that toner having excellent chargeability can be selectively electrodeposited on a second developer carrying member because, when toner once electrodeposited on a first developer carrying member is subsequently again electrodeposited on a second developer carrying member, the inadequately charged toner among said toner electrodeposited on a first developer carrying member loss its charge relatively rapidly, and the inadequately charged toner which has been adhered once to a first developer carrying member migrates to a developer carrying member with difficulty because the inadequately charged toner is dully reactive to the electric field. The amount of liquid adhering to the developer carrying member can be greatly reduced particularly when a second electrodeposition occurs outside the developer tank, thereby reducing the amount of inadequately charged toner contained in the liquid developer and which is the source of background fog.

Thus, the amount of inadequately charged toner contained in the liquid developer supplied to the developing region is greatly reduced, thereby suppressing the occurrence of background fog and improving image quality.

In the present embodiment, inadequately charged toner is maintained on the electrodeposition roller with great effectiveness because the first electrodeposition region d has adequate length. Therefore, there is extremely small amount of migration of inadequately charged toner to the developing roller during a second electrodeposition, providing excellent toner selection effectiveness.

In the present embodiment, part of the carrier liquid remains on the electrodeposition roller 220 via the second electrodeposition performed outside the developer tank, thereby concentrating the liquid developer maintained on the developing roller 202 and adequately reducing the amount of carrier liquid contained in the liquid developer on the developing roller. Thus, there is a reduced amount of inadequately charged toner contained in the liquid developer maintained on developing roller 202.

The liquid developer maintained on developing roller 202 is transported to developing region c via the rotation of developing roller 202, and comes into contact with the surface of photosensitive drum 1. This toner is then attracted to the electrostatic latent image formed on photosensitive drum 1 via the electric field of said latent image and migrates to the surface of photosensitive drum 1 and is adhered to the surface of said latent image via the Coulomb force, thereby developing said electrostatic latent image.

After passing through developing region c, cleaning liquid is sprayed from spray ports 211*a* of tube 211 onto developing roller 202, and the residual developer remaining on the developing roller 202 is removed by cleaning blade 212.

When development ends, the voltage application is terminated, and liquid supply device 21, liquid collection device 22 and developing roller 202 are stopped. The liquid developer in developer tank 208 quickly falls from liquid supply aperture 203 and liquid collection aperture 204 via its own weight.

It is most desirable that the speed of rotation of developing roller 202 is set at the same rotation speed as photosensitive drum 1. In this case, image disruption can be minimized because there is no shearing force acting on the toner adhered to photosensitive drum 1. The aforementioned two rollers may rotate at different speeds if desired, to increase the amount of toner supplied to photosensitive drum 1 when developing roller 202 rotates at a higher speed than photosensitive drum 1, and decrease the amount of toner supplied to photosensitive drum 1 when developing roller 202 rotates at a slower speed than photosensitive drum 1. Furthermore, the developing roller 202 may rotate in the opposite direction to the direction of rotation of photosensitive drum 1 at the opposition region relative to photosensitive drum 1. In this case, the amount of liquid adhered to photosensitive drum 1 can be reduced.

The surface roughness of developing roller 202 is desirably a ten-point mean roughness of less than 5 $\mu$m. In this case, image disruption due to contact between the photosensitive drum 1 and developing roller 202 is prevented, breakdown of the thin toner layer due to contact between the developing roller 202 and thin layer forming electrode 201 is prevented, image irregularities caused by uneven electric field in developing region c are prevented, irregularities of the thin toner layer due to an uneven electric field in second electrodeposition region h are prevented, and cleaning irregularities caused by blade 212 are prevented. The ten-point mean roughness standard is defined in Japanese Industrial Standards JIS B0601.

Although a squeeze roller is provided for removing carrier liquid from the liquid developer adhered to the surface of the photosensitive member in the previously described image forming apparatus, above-mentioned means need not be provided because the amount of carrier liquid adhered to the surface of the photosensitive member is adequately reduced by a plurality of repeated electrodeposition.

A modification is described hereinafter.

Figure 4:
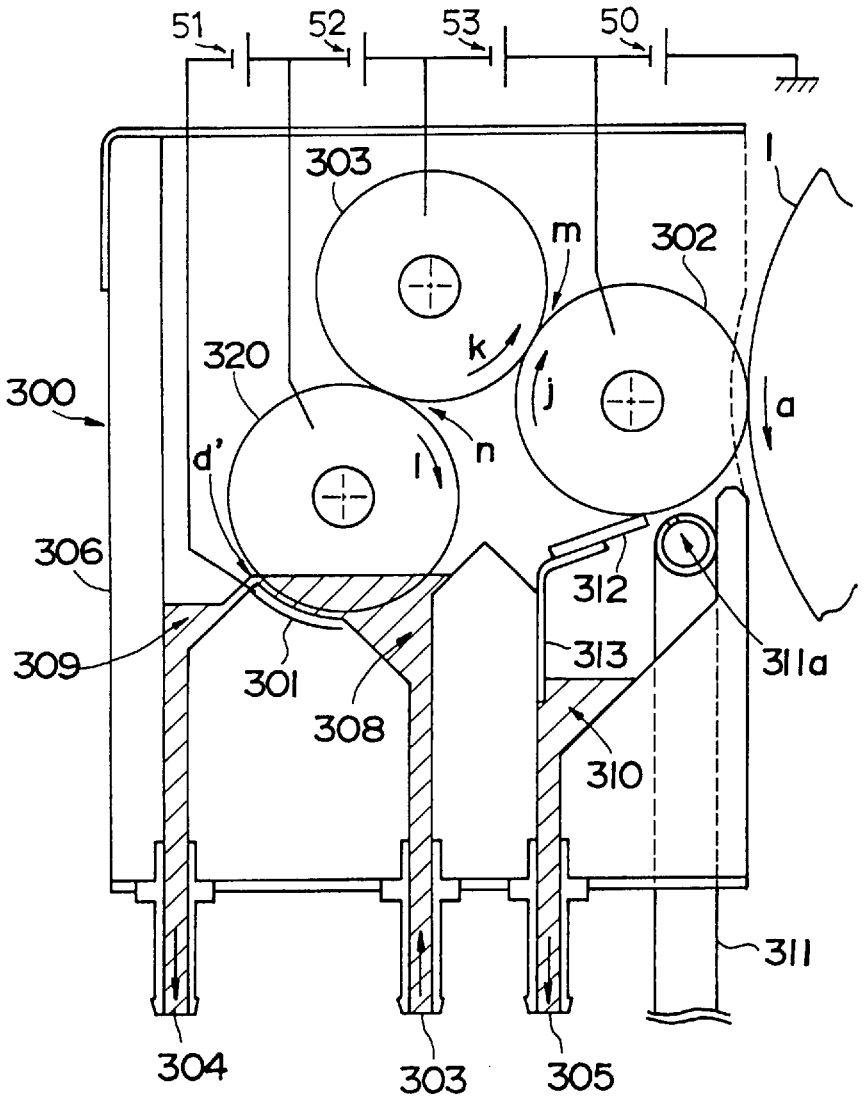
FIG. 4 shows a modification of the developing head.

Developing head 300 shown in FIG. 4 is provided with a total of three developer carrying members: a first electrodeposition roller 320 for accomplishing a first electrodeposition, a second electrodeposition roller 303 for accomplishing a second electrodeposition, and a third electrodeposition roller 302 for accomplishing a third electrodeposition, which accomplish a total of three electrodepositions.

First electrodeposition roller 320 is identical to the electrodeposition roller shown in FIG. 3, and around which are provided electrode 301, liquid supply aperture 303, liquid collection aperture 304, and developer tank 308 which are identical to those shown in FIG. 3. An opposition region d' formed between electrode 301 and first electrodeposition roller 320 comprises a first electrodeposition region. Power supply 51 providing a bias voltage for first electrodeposition is connected with electrode 301 and first electrodeposition roller 320.

Second electrodeposition roller 303 is provided opposite first electrodeposition roller 320 so as to be inclined upward relative to first electrodeposition roller 320, and is supported so as to be rotatable in the arrow k direction in the drawing, i.e., in the same direction as the direction of rotation of first electrodeposition roller 320 at the opposition region relative to said first electrodeposition roller 320. The opposition region n between first electrodeposition roller 320 and second electrodeposition roller 303 is the second electrodeposition region. Power supply 52 providing a bias voltage for second electrodeposition is connected with first electrodeposition roller 320 and second electrodeposition roller 303.

Developing roller 302 is disposed below and at the side of the second electrodeposition roller, and is supported via frame 306 so as to be rotatable in the arrow j direction in the drawing, in the same direction as the direction of rotation of second electrodeposition roller 303 at the opposition region relative to second electrodeposition roller 303. The opposition region m between second electrodeposition roller 303 and developing roller 302 is the third electrodeposition region. Power supply 53 providing a bias voltage for third electrodeposition is connected with second electrodeposition roller 303 and developing roller 302. Power supply 50 for providing development bias voltage is connected with developing roller 301.

For example, the voltages of each of power supplies 51, 52 and 53 may be set at 1,000 V, 500 V and 500 V respectively.

The gap between both rollers in second electrodeposition region n and the voltage applied therebetween, and the gap between both rollers in third electrodeposition region m and the voltage applied therebetween may be set the same as previously described relative to the electrodeposition roller and developing roller of FIG. 3. In repeated electrodepositions, the gap between each of developer carrying members may be gradually smaller in accordance with approbating to photosensitive drum 1 because of reduction of the amount of carrier liquid maintained on the developer carrying member.

The tube 311, cleaning blade 312, and support panel 313 are identical to the respective elements shown in FIG. 3. In considering of the direction of rotation of first electrodeposition roller 320, the liquid collection tank 309 for collecting liquid developer from developing tank 308 that has passed the thin layer forming region, and liquid collection tank 310 for collecting liquid developer remaining on the developing roller 302 are independently provided in the present embodiment. Liquid collection aperture 305 provided at the bottom of liquid collection tank 310, and liquid collection aperture 304 may be connected to the liquid collection device shown in FIG. 2.

By increasing the number of electrodepositions, the effectiveness of selection of toner exhibiting excellent chargeability can be improved, and the amount of carrier liquid adhering to the electrostatic latent image carrying member can be reduced.

Although each of the above-mentioned embodiments have been described in terms of using an electrode for forming an opposition region of a desired length between developer carrying members for a first electrodeposition, the present invention is not limited to such an arrangement, and may be constructed, for example, such that a first electrode position may occur between two developer carrying members.

Developing head 400 shown in FIG. 5 draws liquid developer by means of a draw roller without electrodeposition, and subsequently accomplishes a first electrodeposition between said draw roller and electrodeposition roller, then accomplishes a second electrodeposition from said electrodeposition roller to a developing roller.

Figure 5:
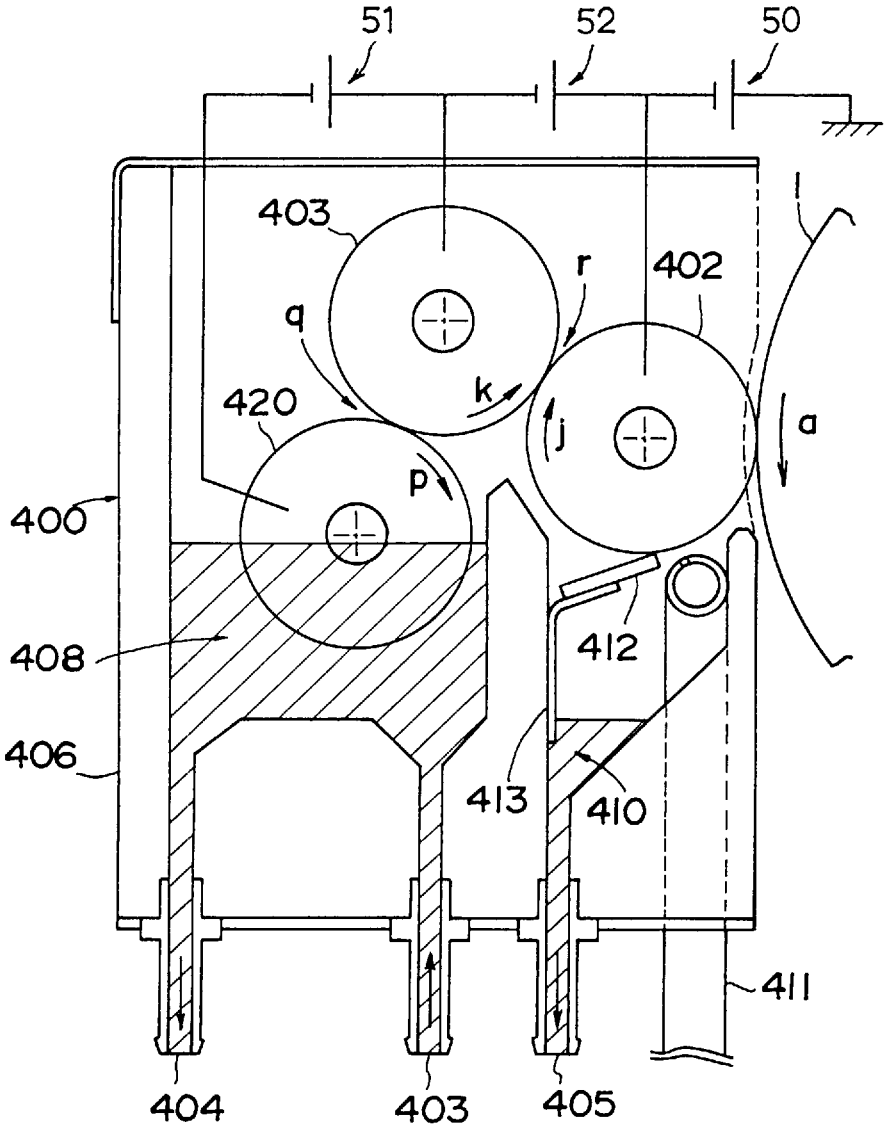
FIG. 5 shows another modification of the developing head.

As shown in FIG. 5, draw roller 420, electrodeposition roller 403, and developing roller 402 in developing head 400 are supported by frame 406 in an identical arrangement to the first electrodeposition roller, second electrodeposition roller, and developing roller shown in FIG. 4.

Within developing head 400 are provided liquid collection tank 410, tube 411, cleaning blade 412, and support panel 413 identical to the elements of FIG. 4.

Power supply 51 providing a bias voltage for first electrodeposition is connected with draw roller 420 and electrodeposition roller 403. Power supply 52 providing a bias voltage for second electrodeposition is connected with electrodeposition roller 403 and developing roller 402. Power supply 50 providing a bias voltage for development is connected with developing roller 402.

Below draw roller 420 is provided a developer tank 408 for accommodating liquid developer. Liquid developer is supplied from liquid supply aperture 403 to developer tank 408, and supplied liquid developer is collected from liquid collection aperture 404. Thus, as the liquid circulates within developer tank 408, a predetermined amount of liquid developer is stored, and saturates draw roller 420.

Draw roller 420 mechanically supports liquid developer on its surface via the rotation of the roller in the arrow p direction in the drawing, and transports said developer to opposition region q (first electrodeposition region) of electrodeposition roller 403. In first electrodeposition region q, toner image the liquid developer maintained on draw roller 420 is electrodeposited on electrodeposition roller 403.

The liquid developer on electrodeposition roller 403 is transported to opposition region r (second electrodeposition region) of developing roller 402 via the rotation of electrodeposition roller 403. In second electrodeposition region r, the toner in the liquid developer on electrodeposition roller 403 is again electrodeposited on developing roller 402.

The gap between both rollers in first electrodeposition region q and the voltage applied therebetween, and the gap between both rollers in second electrodeposition region r and the voltage applied therebetween may be set the same as previously described relative to the electrodeposition roller and developing roller of FIG. 3.

In conventional image forming apparatus using liquid developing methods, a developer tank often is arranged below an electrostatic latent image carrying member to naturally accomplish development on the bottom portion of said latent image carrying member to avoid adverse affects of dripped liquid developer. Conversely, repeated electrodeposition using a plurality of developer carrying members to transport the toner to a developing region greatly increases the freedom of designing the transport path of the liquid developer, as in the previously described embodiments. Thus, it is possible to have an enlarged range of relative positionings of the liquid developing device relative to an electrostatic latent image carrying member.

For example, in the above embodiments the liquid developer transport path was set in a horizontal direction via the arrangement of the developer carrying members in a horizontal direction, and placement of the liquid developing device at the side of the photosensitive drum. Thus, toner image transfer is possible at positions confronting the bottom portion of the photosensitive drum used by many image forming apparatuses utilizing dry-type developing methods. Therefore, parts-diversion from image forming apparatuses using dry-type developing method is capable.

In multicolor image forming apparatuses having a plurality of developing devices for developing a variety of different colors, the arrangement of the various developing devices is generally restricted to prevent color mixing, but the previously described enlarged range of relative positioning of the liquid developing device relative to latent image carrying members could be effectively used in such circumstances.

Although the second and subsequent electrodepositions are accomplished outside the developer tank in the previously described embodiments, it is to be noted that the present invention is not limited to such an arrangement inasmuch as a plurality of developer carrying members may be provided within a developer tank and repeated electrodeposition may be accomplished within the liquid.

<Composition of liquid developer>

The liquid developer contains at least a carrier liquid and toner particles dispersed therein. It is to be understood that other additional agents such as charge controlling agents, dispersion agents, dispersion stabilizing agents and the like.

The volume average particle size of the toner particles is desirably regulated from 0.5 $\mu$m to 5 $\mu$m. Moreover, toner particle size should be regulated to within a mean volume particle size of±1 $\mu$m per 80 percent by volume, and preferably±0.5 $\mu$m per 80 percent by volume to the total amount of toner particles. The volume average particle size and the particle size distribution can be measured by a particle size distribution measurement apparatus (SALD-1100: Shimadzu K.K.).

Polymer micro particles obtained by either dry or liquid manufacturing methods may be used as the aforementioned toner particles. Dry manufacturing methods include dry pulverization method, spray drying methods and the like. Liquid manufacturing methods include in-solvent grinding methods, suspension polymerization methods, emulsion polymerization methods, nonaqueous dispersion polymerization methods, seed polymerization methods, emulsion dispersion granulation methods and the like. Useful polymer particles manufactured by emulsion dispersion granulation methods or spray drying methods are desirable due to the many types of usable resins, the ease of molecular weight regulation, resin blending characteristics, and sharpness of particle diameter distributions. In-solvent pulverization methods are also advantageous insofar as toner particles can be inexpensively produced.

Emulsion dispersion granulation methods dissolve polymers in a nonaqueous organic solvents to produce a polymer solution which is emulsion dispersed in an aqueous solution to form an oil-in-water (O/W) emulsion. This emulsion is heated while being agitated to vaporize the organic solvents, whereupon the polymer particles are extracted to obtain the polymer micro particles.

Spray drying methods dissolve polymers in organic solvents and regulated the polymer solution in which is dispersed coloring agents and other constituents. The obtained polymer solution is sprayed from nozzles and the spray is heated to vaporize the organic solvents and obtain the polymer micro particles.

When polymer particles of the above-mentioned types are used as toner particles in a liquid developer, the washed and dried polymer particles may be dispersed in an insulative carrier liquid using an ultrasonic dispersion device or the like together with an additional material added as required, such as, for example, charge regulating agents, dispersion enhancing agents, resins and the like.

Resins useful for polymer particles are not specifically limited, and may include, for example, polyester resin, styrene-acrylic copolymer, polystyrene, polyvinyl chloride, polyvinyl acetate, polymethacrylate ester, polyacrylate ester, epoxy resin, polyethylene, polyurethane, polyamide, paraffin wax, and the like used individually or in blends.

Constituents such as coloring agents, charge controlling agents, offset preventing agents and the like may be added to the polymer particles as needed.

Various pigments and dyes such as carbon black and phthalocyanine and the like may be used as coloring agent. However, coloring agents may not be necessary when colored resins are used.

Electrically insulative organic substances may be used as the carrier liquid used in the liquid developer, insofar as such substances do not change state at room temperature if they are in a fluid state during development. Examples of useful substances include aliphatic hydrocarbons, alicyclic hydrocarbons, aromatic hydrocarbons, halogenated hydrocarbons, polysiloxane and the like. However, normal paraffin and isoparaffin solvents are desirable in view of their low cost, odorlessness, and nontoxicity.

Specifically, Isopar-G, Isopar-H, Isopar-L, Isopar-K (all manufactured by Esso Co.), Shelzol-71 (Shell Oil Co.), IP solvent 1620 and IP solvent 2028 (both manufactured by Idemitsu Sekiyu Kagaku K.K.) are particularly desirable. Examples of useful substances which are solids at room temperature include waxes, paraffins and the like.

Charge controlling agents, dispersal agents, dispersion stabilizing agents and the like may be added to the carrier liquid of the liquid developer.

A variety of common materials may be used as charge controlling agents. For example, to impart a positive polarity charge to the toner particles, metal salts of organic acids including metal salts of a fatty acids such as stearic acid and the like, metal salts of sulfosuccinic acid ester, and metal salts of abietic acid and the like, and soluble polymers such as alkyd resins to attract particles may be used. For example, to impart a negative polarity charge to the toner particles, surface active agents such as lecithin and the like, nitrogen compounds, and soluble polymers may be used. The aforementioned charge controlling agents may be added at a rate in a range between 0.0001 and 10 percent by weight, and preferably between 0.001 and 3 percent by weight of the carrier liquid.

Metal oxides such as $SiO_2$, $Al_2O_3$, $TiO_2$ or ZnO and the like may be added as charge enhancing agents to the same amounts as charge controlling agents.

The previous mentioned types of surface active agents and soluble polymers may be used as dispersion agents and dispersion stabilizing agents to stabilize the dispersion of toner particles in the liquid developer.

Useful soluble polymers are not limited to the aforementioned examples inasmuch as polyolefin petroleum resins, linseed oil, polyalkylmethacrylate and the like, and copolymers of small amount of monomers having a polar group such as methacrylate, acrylate, alkylaminoethyl methacrylate and the like may be used to increase the affinity for the polymer particles. Soluble polymers should be added at a rate of between 0.01 and 20 percent by weight, and preferably 0.1 and 10 percent by weight relative to the carrier liquid to improve dispersability, prevent elevation of viscosity due to its addition.

Examples of useful surface active agents include natural surface active agents such as saponin, nonionic surface active agents such as alkylene oxide, glycerine, glycidol and the like, and anionic surface active agents such as carbonic acid, sulfonic acid, phosphoric acid, and acidic radicals such as sulfate ester radical, phosphate ester radical and the like.

In the liquid developer, the ratio of solid constituents per total weight (solid content ratio) of toner, dispersion agents and the like is between 1 and 90 percent by weight per total amount of liquid developer. However, the aforementioned solid content ratio is preferably between 2 and 50 percent by weight to reduce the total amount of developer used in developing and for ease of handing.

Experimental examples will be described below. Wherever the word "parts" is mentioned, it invariably refers to "parts by weight."

<Manufacturing method of toner A>

Low molecular weight polyester resin (MW: 15000, Mn: 6000) 100 parts by weight was completely dissolved in methylene chloride to make the density of 20 percent by weight. Using an Eiger motor mill (manufactured by Eiger Japan K.K.), phthalocyanine 6 parts by weight was dispersed in the above-obtained resin solution as a coloring agent.

Using a Homomixer (manufactured by Tokushu Kika Kogyo K.K.), the resin solution obtained as described above was emulsion dispersed for 30 minutes at room temperature in an aqueous dispersal solution of 1% aqueous dispersal agent (Metrose 65-SH-50; manufactured by Shin-Etsu Chemical Co.) and 1% sodium lauryl sulfate rotating 8,000 times every minute after which an O/W emulsion was obtained. Next, the homomixer was replaced by a stirring blade with four blades and the methylene chloride removed while stirring for 3 hours at 40° to 45° C. and an aqueous suspension of polymer micro particles for toner with an volume average particle size of 2 $\mu$m was obtained.

After removing the solid from the obtained aqueous suspension using a centrifugal separator and thoroughly washing that solid with water, it was filtered and dried and resin micro particles with an volume average particle size of 2 $\mu$m were obtained. This was designated toner A.

EXAMPLE

High quality images without background fog can be obtained and sufficiently small amount of carrier liquid adhering to the surface of the photosensitive member can be accomplished by using developer A in the electrophotographic printer 100 shown in FIGS. 1 through 3 under the conditions described below for reverse development.

Developing roller ten-point mean roughness: 2 $\mu$m

Gap between developing roller and photosensitive drum at developing region c: 100 $\mu$m Voltage applied to developing roller:+550 V Gap between developing roller and electrodeposition roller at second electrodeposition region h: 200 $\mu$m Voltage applied between developing roller and electrodeposition roller: 500 V Gap between electrode and electrodeposition roller at first electrodeposition region: 1 mm Voltage applied between electrode and electrodeposition roller: 1,000 V Flow rate: 200 cc/min Length of developing region in lengthwidth direction of developing roller: 320 mm Rotation speed of photosensitive drum: 20 cm/sec Rotation speed of developing roller: 22 cm/sec Surface potential of unexposed portion of photosensitive drum:+750

Surface potential of exposed portion of photosensitive drum:+50 V

Diameter of developing roller: 30 mmΦ

Rotation speed of electrodeposition roller: 24 cm/sec

Diameter of electrodeposition roller: 30 mmΦ

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A liquid developer transporting device disposed between a reservoir accommodating a liquid developer comprising a fluid medium, a charge controlling agent and electrically charged toner particles dispersed therein and an electrostatic latent image carrying member, wherein said toner particles comprises a resin and a colorant, comprising:

(a) a first developer carrying member;

(b) a supplier which supplies a liquid developer accommodated in the reservoir to the first developer carrying member;

(c) a first deposition device which electrically deposits toner particles on the first developer carrying member;

(d) a second developer carrying member confronting the first developer carrying member;

(e) a second deposition device which electrically deposits toner particles on the second developer carrying member at the confrontation area between first and second developer carrying members;

(f) a third liquid developer carrying member confronting with the second developer carrying member; and (g) a third deposition device which electrically deposits toner particles on the third developer carrying member at the confrontation area between second and third developer carrying members.

2. The transporting device as claimed in claim 1 wherein said first deposition device comprising:

(a) an electrode confronting the first carrying member; and (b) an electric power source which applies a voltage between said electrode and said first carrying member.

3. The transporting device as claimed in claim 2 wherein said first developer carrying member and said electrode are immersed in the liquid developer accommodated in the reservoir, and said reservoir serves as the supplier.

4. The transporting device as claimed in claim 2 wherein the area of confrontation between the electrode and the first developer carrying member is 3 mm long or more.

5. The transporting device as claimed in claim 1 wherein said second deposition device comprises an electric power source which applies a voltage between said first and second developer carrying members.

6. The transporting device as claimed in claim 1 wherein said second developer carrying member confronts said latent image carrying member and contacts the liquid developer carried thereon with the latent image carrying member.

7. The transporting device as claimed in claim 1 wherein said third developer carrying member confronts said latent image carrying member and contacts the liquid developer carried thereon with the latent image carrying member.

8. The transporting device as claimed in claim 1 wherein said supplier comprises a developer drawing member which supplies liquid developer by contacting the surface thereof with the liquid developer accommodating in the reservoir and mechanically drawing the liquid developer.

9. The transporting device as claimed in claim 1 wherein said first and second developer carrying members are electrically conductive rollers.

10. The transporting device as claimed in claim 1 wherein said first and second deposition devices apply at least one kind of electric voltage selected from the group consisting of direct current voltage, alternating current voltage overlaid on direct current voltage and pulse voltage overlaid on direct current voltage.

11. The transporting device as claimed in claim 1, wherein said charge controlling agent comprises, a compound selected from the group consisting of metal salts of organic acids, metal salts of fatty acids, metal salts of organic acid ester, soluble polymers, surface active agents, and nitrogen compounds.

12. The transporting device as claimed in claim 1, wherein said liquid developer contains said charge controlling agent in an amount of 0.0001 to 10 percent by weight relative to the fluid medium.

13. The transporting device as claimed in claim 1, wherein said toner particles have volume average particle size of 0.5 $\mu$m to 5 $\mu$m.

14. A liquid developer transporting device disposed between a reservoir accommodating a liquid developer comprising a fluid medium, a charge controlling agent and electrically charged toner particles dispersed therein and an electrostatic latent image carrying member, wherein said toner particles comprise a resin and a colorant, comprising:

(a) a plurality of developer carrying members confront each other sequentially;

(b) a supplier which supplies a liquid developer accommodated in the reservoir; and (c) a deposition device which electrically deposits toner particles on the developer carrying member nearest to or in the reservoir and wherein electrodeposition is repeated between the remaining developer carrying members one after another so as to transport toner particles, and wherein each of gaps between developer carrying members confronting each other decrease in accordance with approaching direction to the electrostatic latent image carrying member along to the developer transportation path.

15. The transporting device as claimed in claim 1 wherein said developer carrying members are electrically conductive rollers.

16. The transporting device as claimed in claim 1 wherein said developer carrying members are arranged in the horizontal direction.

17. The transporting device as claimed in claim 1 which is disposed at the side of the electrostatic latent image carrying member.

18. The transporting device as claimed in claim 14 wherein said electrodeposition device repeats the electrodeposition out of the reservoir.

19. The transporting device as claimed in claim 14 wherein said electrodeposition device applies at least one kind of electric voltage selected from the group consisting of direct current voltage, alternating voltage overlaid on direct current voltage and pulse voltage overlaid on direct current voltage.

20. A liquid developing device for developing an electrostatic latent image by a liquid developer comprising a fluid medium, a charge controlling agent and toner particles dispersed therein, wherein said toner particles comprise a resin and a colorant, comprising:

(a) a developer carrying member which contacts a liquid developer carried thereon with an electrostatic latent image carrying member;

(b) a toner deposition member confronting the developer carrying member;

(c) a first deposition device which electrically deposits toner particles from a liquid developer on the toner deposition member;

(d) a second deposition device which electrically deposits toner particles on the developer carrying member at the confrontation area between said developer carrying member and toner deposition member, and wherein said developer carrying members and toner deposition members are electrically conductive rollers; and (e) a liquid sprayer which sprays a cleaning solution to the developer carrying members.

21. The developing device as claimed in claim 20 which further comprises a remover which removes the residual developer from the developer carrying member.

* * * * *

UNITED STATES PATENT AND TRADEMARK OFFICE

CERTIFICATE OF CORRECTION

PATENT NO. : 5,826,148

DATED : October 20, 1998

INVENTOR(S) : Shuji IINO et al.

It is certified that error appears in the above-identified patent and that said Letters Patent is hereby corrected as shown below:

Col. 16, line 50, delete "1" and insert --15--; and line 57, delete "1" and insert --14--.

Signed and Sealed this

Twentieth Day of July, 1999

*Attest:*

*Attesting Officer*

Q. TODD DICKINSON

*Acting Commissioner of Patents and Trademarks*